US006061461A

United States Patent [19]

Paddock

[11] Patent Number: 6,061,461

[45] Date of Patent: May 9, 2000

[54] AUDIO TRANSDUCER

[76] Inventor: Paul W. Paddock, 5001 NE. Mineral Springs Rd., McMinnville, Oreg. 97128

[21] Appl. No.: 09/075,456

[22] Filed: May 8, 1998

[51] Int. Cl.[7] ..... H04R 25/00

[52] U.S. Cl. ..... 381/424; 381/423; 381/186; 381/430

[58] Field of Search ..... 381/182, 186, 381/400, 405, 423, 424, 430; 181/65, 163, 164

[56] References Cited

U.S. PATENT DOCUMENTS

| | | | |
|---|---|---|---|
| 1,560,502 | 11/1925 | De Forest . | |
| 1,638,245 | 8/1927 | Davis . | |
| 1,667,149 | 4/1928 | Gerlach . | |
| 1,668,509 | 5/1928 | Koch . | |
| 1,672,796 | 6/1928 | Whitmore . | |
| 1,698,374 | 1/1929 | Pack . | |
| 1,735,860 | 11/1929 | Hutchison . | |
| 1,740,161 | 12/1929 | Duffy . | |
| 1,788,385 | 1/1931 | Duffy . | |
| 1,821,469 | 9/1931 | Hicks . | |
| 1,831,484 | 11/1931 | Duffy . | |
| 1,845,585 | 2/1932 | Duffy . | |
| 1,849,892 | 3/1932 | Van Bezel . | |
| 1,862,582 | 6/1932 | Schlenker . | |
| 1,864,615 | 6/1932 | Quinby . | |
| 1,866,090 | 7/1932 | De Forest . | |
| 1,895,494 | 1/1933 | Smythe . | |
| 1,900,111 | 3/1933 | Hicks . | |
| 1,930,186 | 10/1933 | Swallow | 179/115.5 |
| 2,013,695 | 9/1935 | Nicolson | 181/31 |
| 3,093,207 | 6/1963 | Bozak | 181/32 |
| 3,456,755 | 7/1969 | Walker | 181/31 |
| 3,477,540 | 11/1969 | Rizo-Patron | 181/31 |
| 3,685,609 | 8/1972 | Franssen | 181/31 |
| 3,686,446 | 8/1972 | Manger | 179/115.5 |
| 4,584,439 | 4/1986 | Paddock | 179/115.5 |
| 4,903,308 | 2/1990 | Paddock | 381/202 |
| 5,230,021 | 7/1993 | Paddock | 381/202 |
| 5,249,237 | 9/1993 | Paddock | 381/202 |
| 5,450,497 | 9/1995 | Paddock | 381/191 |
| 5,570,429 | 10/1996 | Paddock | 381/202 |

*Primary Examiner*—Curtis A. Kuntz
*Assistant Examiner*—Suhan Ni
*Attorney, Agent, or Firm*—Marger Johnson & McCollom, P.C.

[57] ABSTRACT

An improved transducer which includes a rigid frame and a permanent ring magnet mounted to the frame. A small bobbin, preferably formed of aluminum foil, is sized and arranged to fit within the open end of the magnetic gap while permitting motion of the bobbin therein. A voice coil is wound on the bobbin and connectable to receive an audio signal, similar to a conventional voice coil driver system. A pair of flexible, curved diaphragms are disposed in the frame, generally free to move except for a distal end of each diaphragm which is fixed to the frame. The diaphragms can be of generally cylindrical or partial-cylindrical shape.

22 Claims, 10 Drawing Sheets

FIG. 1 (PRIOR ART)
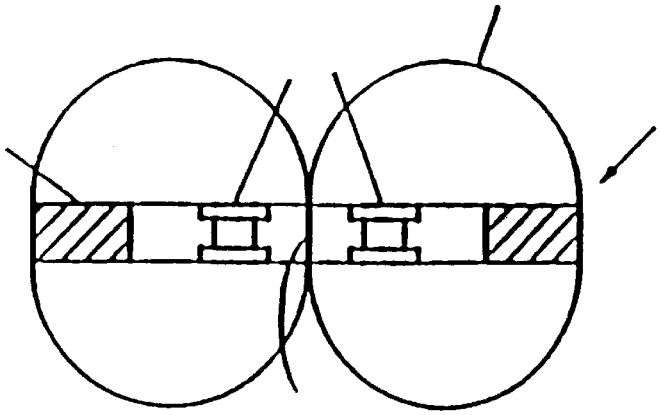
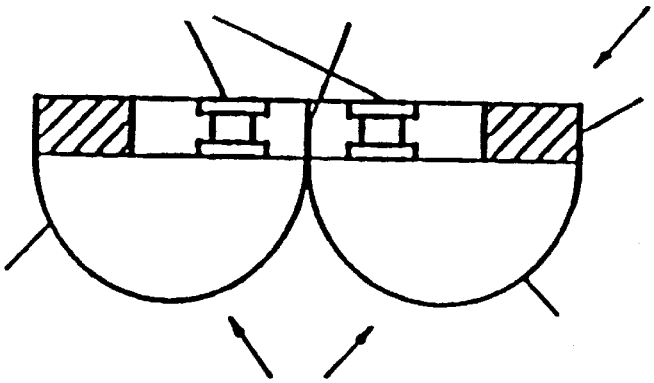
FIG. 2 (PRIOR ART)

AUDIO TRANSDUCER

BACKGROUND OF THE INVENTION

This invention generally relates to audio transducers. More specifically, the invention pertains to improvements in the design of a transducer having one or more cylindrical or partially-cylindrical arcuate diaphragm and methods and apparatus for coupling the diaphragm to a voice coil driver system.

The prior art includes various audio transducers, some of which have a diaphragm that can generally be described as cylindrical in the broadest sense of the term. The cross-sectional profile need not be circular, but may be an open or closed polygon or curve. The cylindrical diaphragms may generally be formed from flat sheets that are curved so that all lines normal to the curved surface remain perpendicular to the longitudinal axis of the diaphragm. A variety of diaphragms of this type are disclosed in PCT Application International Publication No. WO93/23967. FIG. 1 is a top view of a prior art audio transducer having a pair of generally cylindrical diaphragms as described in the PCT application. FIG. 2 is a top view of another prior art audio transducer, having a pair of diaphragms with semi-circular cross sections in a numeral three arrangement. Additionally, various driver systems are known in the prior art, including voice coils and etched coils. FIG. 3 is a simplified perspective view of a transducer having a pair of cylindrical diaphragms and a double-sided etched coil driver system. In this arrangement, a coil is formed on a printed circuit type of substrate material and connected to adjacent portions of the two diaphragm lobes. This arrangement is shown in greater detail in FIG. 4, an enlarged, top view of a central portion of the transducer of FIG. 3, showing detail of the etched coil connected intermediate proximate edges of the diaphragms. Additional detail of transducers of this general type are disclosed in my prior U.S. Pat. No. 5,249,237.

While various prior art transducers are reasonable efficient, and provide relatively flat frequency response, there remains a need for additional improvements in the performance and cost of audio transducer systems. The present invention provides an improved audio transducer that can be manufactured at very low cost, while still providing excellent performance.

SUMMARY OF THE INVENTION

One aspect of the invention is an improved audio transducer, especially useful as a tweeter but not so limited. The improved transducer includes a rigid frame and a permanent ring magnet mounted to the frame as is conventional. A small bobbin, preferably formed of aluminum foil, is sized and arranged to fit within the open end of the magnetic gap while permitting motion of the bobbin therein. A voice coil is wound on the bobbin and connectable to receive an audio signal, similar to a conventional voice coil driver system. A pair of flexible, curved diaphragms are disposed in the frame, generally free to move except for a distal end of each diaphragm which is fixed to the frame. The diaphragms can be of generally cylindrical or partial-cylindrical shape.

The proximate ends of the diaphragms are connected together in a spaced relationship by a pliable decoupling pad, preferably formed of a closed-cell foam tape, for decoupling the diaphragms from one another, while providing for driving them with the single voice coil driver assembly. The proximate ends of the diaphragms and the decoupling pad together form a diaphragm beam assembly. A central notch in the beam assembly reduces mass and improves performance.

The bobbin is suspended in place by a flexible elastomeric mounting ring, overlying the magnet and registered over the gap. The bobbin is connected to the mounting ring by way of two joining discs, preferably formed of aluminum. The same joining discs are also connected to the diaphragm beam for transmitting energy to the diaphragms to generate sound in response to the audio signal, while spacing the diaphragm beam apart from the mounting ring. These and other aspects of the invention described in greater detail below provide reduced material costs, ease of assembly, and good performance in the improved audio transducer.

BRIEF DESCRIPTION OF THE DRAWINGS

FIG. 1 is a top view of a prior art audio transducer having a pair of generally cylindrical diaphragms.

FIG. 2 is a top view of a prior art audio transducer having a pair of diaphragms with semi-circular cross-sections in a numeral-three arrangement.

DETAILED DESCRIPTION OF A PREFERRED EMBODIMENT

Figure 5:
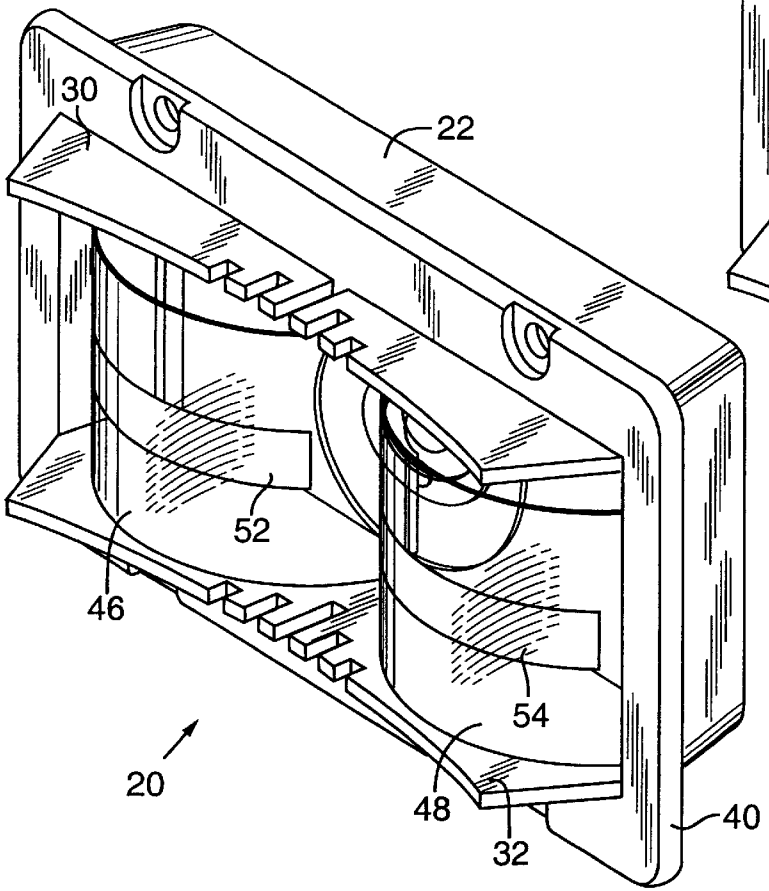
FIG. 5 is a perspective view of an improved audio transducer according to the present invention.

FIG. 5 is a perspective view of a preferred audio transducer according to the present invention. In general, the transducer comprises a pair of generally cylindrical diaphragms coupled to a common voice coil driver system, all of which is mounted within a rigid frame, as described in greater detail below.

Figure 3:
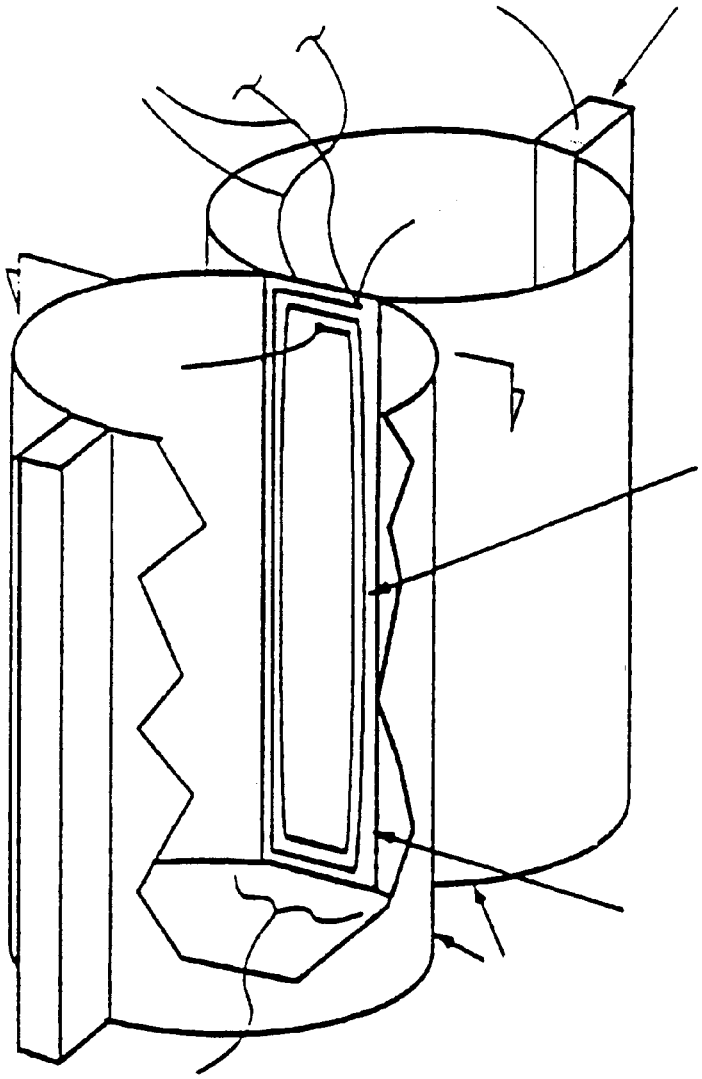
FIG. 3 (PRIOR ART)
FIG. 3 is a simplified perspective view of an audio transducer having a pair of cylindrical diaphragms and a double-sided etched coil driver system connected intermediate the proximate edges of the diaphragms.
Figure 4:
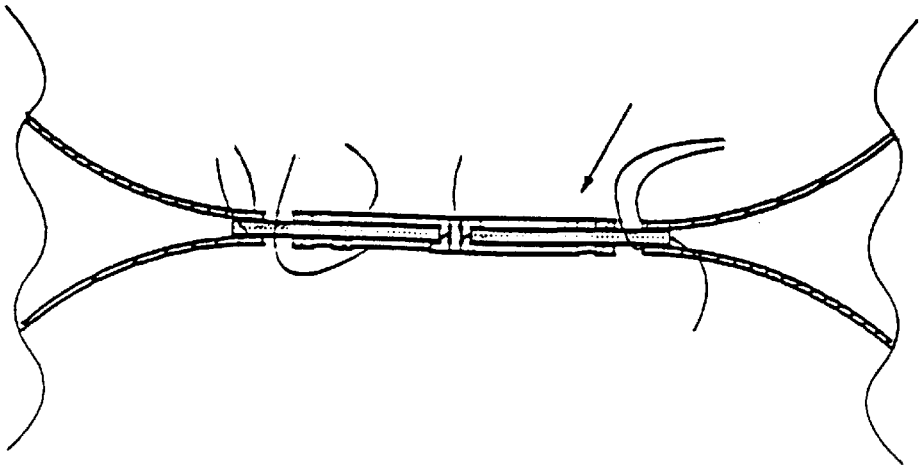
FIG. 4 (PRIOR ART)
FIG. 4 is an enlarged, top view of a central portion of the transducer of FIG. 3 showing detail of the double-sided etched coil driver system connected intermediate the proximate edges of the diaphragms.
Figure 6:
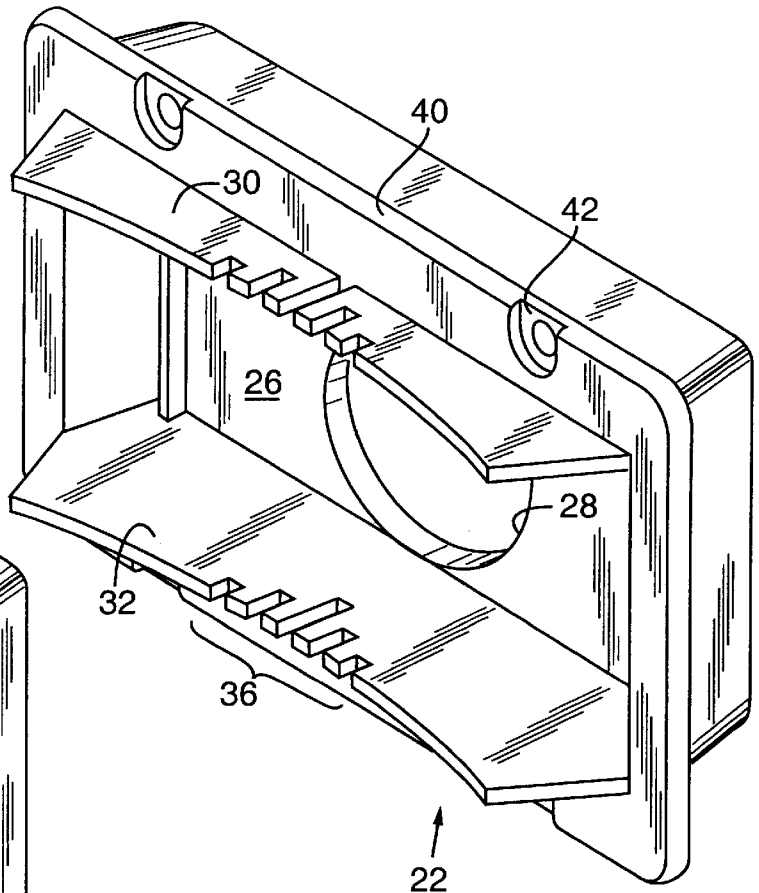
FIG. 6 is a perspective view of only the frame portion of the improved audio transducer of FIG. 5.

FIG. 6 is a perspective view of only the frame portion of the transducer system of FIG. 5. The frame can be formed of any rigid material, and preferably is molded of a polymeric material. The frame 22 has a solid backside 26 that includes a central aperture 28. The aperture 28 is sized for receiving the magnet of the driver system as further described later. Frame 22 further includes a flange 40 extending around its periphery for mounting the transducer. Recessed mounting holes 42 can be provided in the mounting flange 40 as appropriate. The frame 22 is generally bilaterally symmetric, and further includes an opposed top plate 30 and bottom plate 32, arranged in parallel and together defining an opening in the front of the frame sized to receive yet clear the diaphragms. The top and bottom plates, 30, 32, each include a series of slots, for example slots 36, which are cut into the front edge of a central portion of the top and bottom plates. Additionally, the front edges of the top and bottom plates are mildly concave, tapering inward toward the center portion. These slots improve performance of the transducer by impeding reflections particularly at higher frequencies. FIG. 5 shows the general arrangement of a pair of diaphragms 46 and 48 mounted in the open front of frame 22 as further described shortly.

Figure 7:
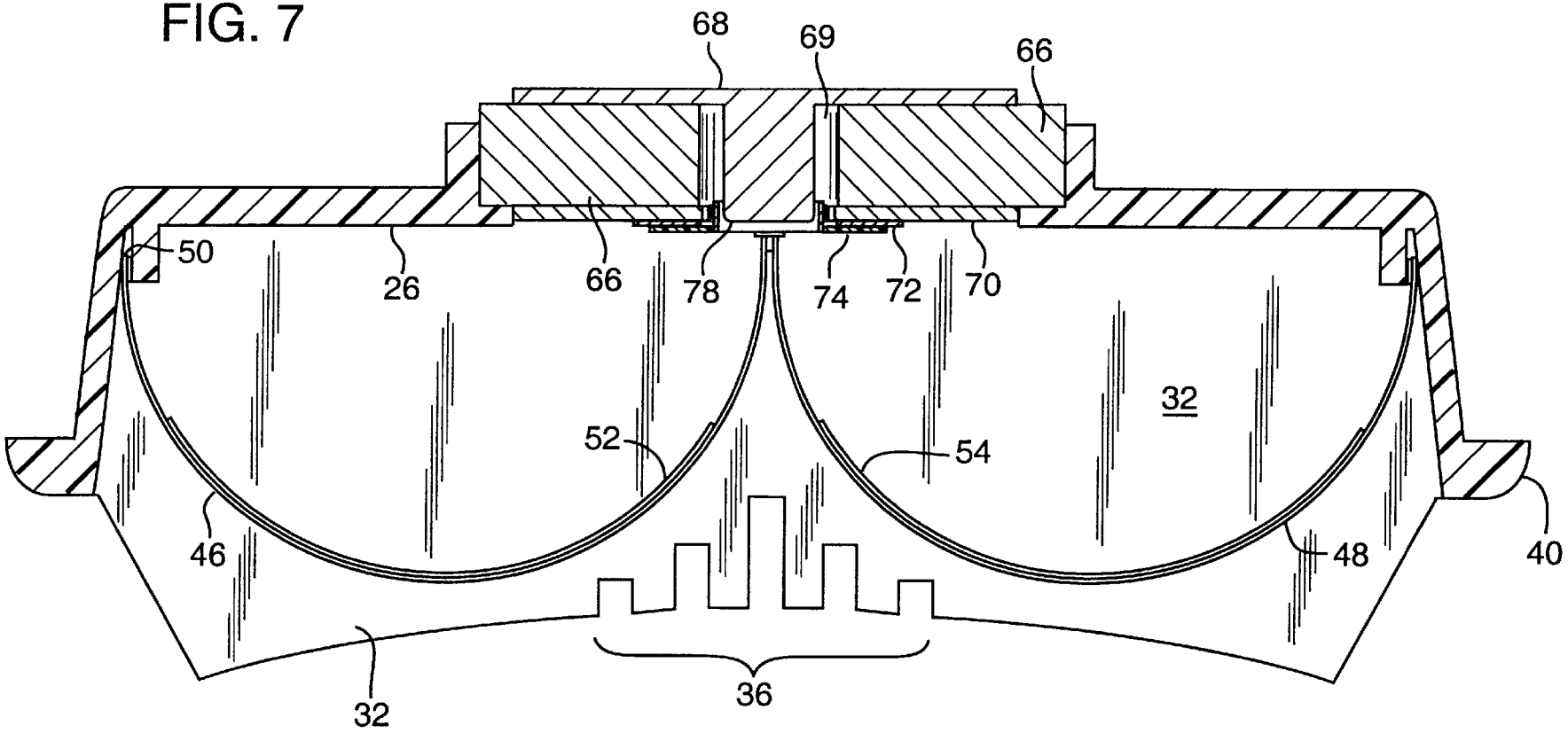
FIG. 7 is a cross-sectional top view of the audio transducer of FIG. 5

FIG. 7 is a cross-sectional view of the transducer of FIG. 5 looking downward from the top of the transducer. In this view, one can observe that the diaphragms 46, 48 are symmetrically arranged, generally side by side in a parallel arrangement within the frame. The outside, or distal ends of the diaphragms, e.g., distal end 50 of the left diaphragm 46, are fixed to the frame, for example, by use of an adhesive in a slot provided for that purpose. In this view, one can better see the driver system mounted in the frame. The driver system includes a permanent ring magnet 66 which is fixed to the frame 22 in aperture 28. The permanent magnet further includes a steel pole 68 overlying the back side of the ring magnet as shown, and extending through the open core of the ring magnet toward the front of the frame. The steel pole 68 is sized to leave a magnet gap 69 between the steel pole and the ring magnet. A steel top plate 70 having a central aperture diameter as the ring magnet aperture is fixed to the front side of the magnet. The steel plates are fixed to the ring magnet so as to provide an annular magnet gap 69 between the poles of the magnet. In this view one can also observe damping tape 52 and 54, adhered to interior surfaces of the diaphragms 46, 48, respectively, as better seen in the perspective view of FIG. 5. These damping tapes are further described in the prior art patents identified above.

Figure 8:
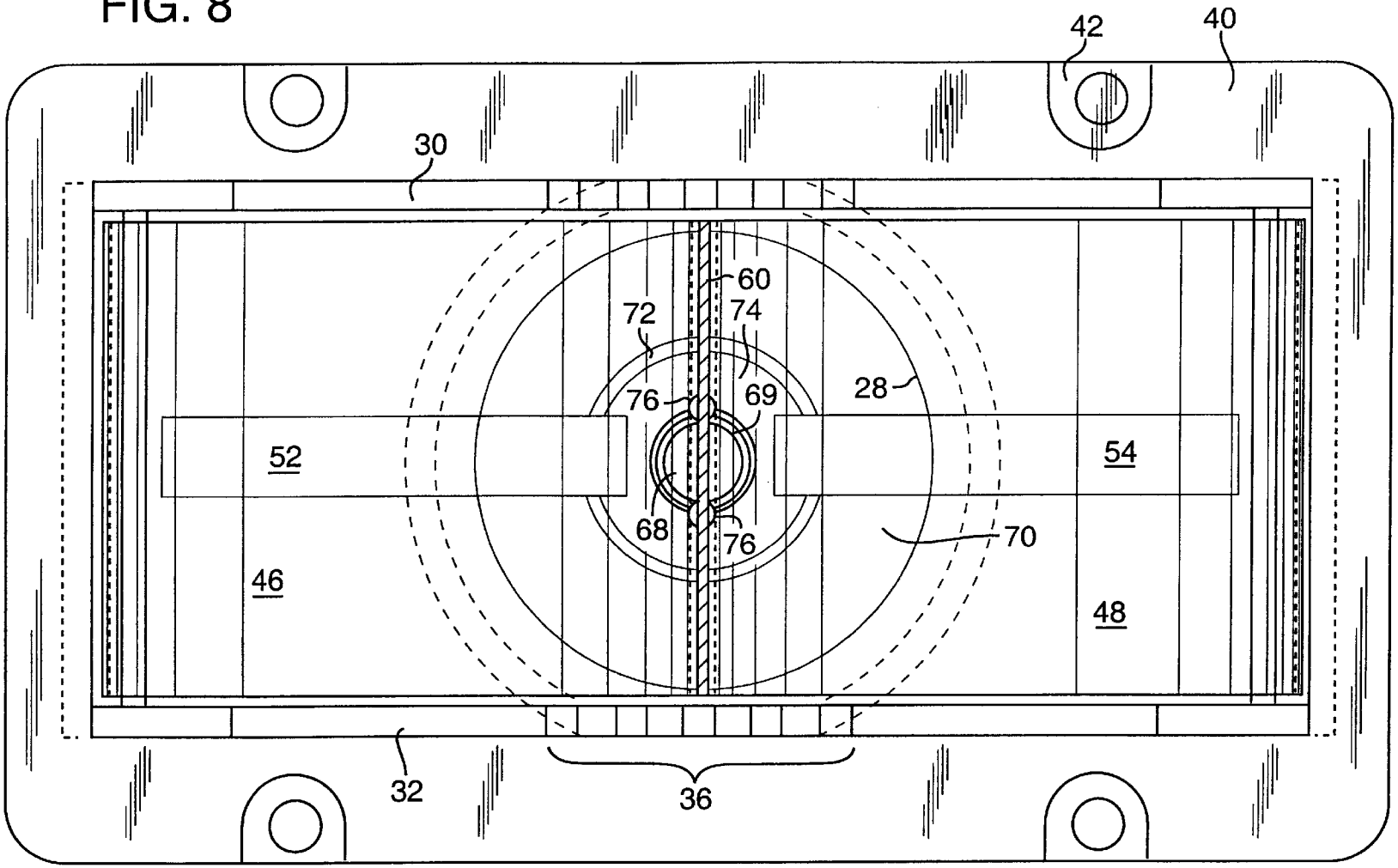
FIG. 8 is cross-sectional front view of the audio transducer of FIG. 5.

FIG. 8 is a front view of the audio transducer of the previous figures. In this view, one can observe various structures underlying the diaphragms as the diaphragm typically would be formed of a transparent material. Preferably, the diaphragms are formed of a plastic film and more specifically, a polyester material, having a thickness of approximately 2 mil. In this view from the open front of the transducer, one can observe the steel top plate 70 overlying the ring magnet and mounted in the aperture 28 of the frame. An annular spacer 72 is positioned in parallel with and overlying the top plate 70. An elastomeric mounting ring 74 is positioned overlying the spaced 72. One can also observe in this view the steel pole 68, magnet gap 69, and mounting discs 76, all of which are described in greater detail shortly.

Figure 9:
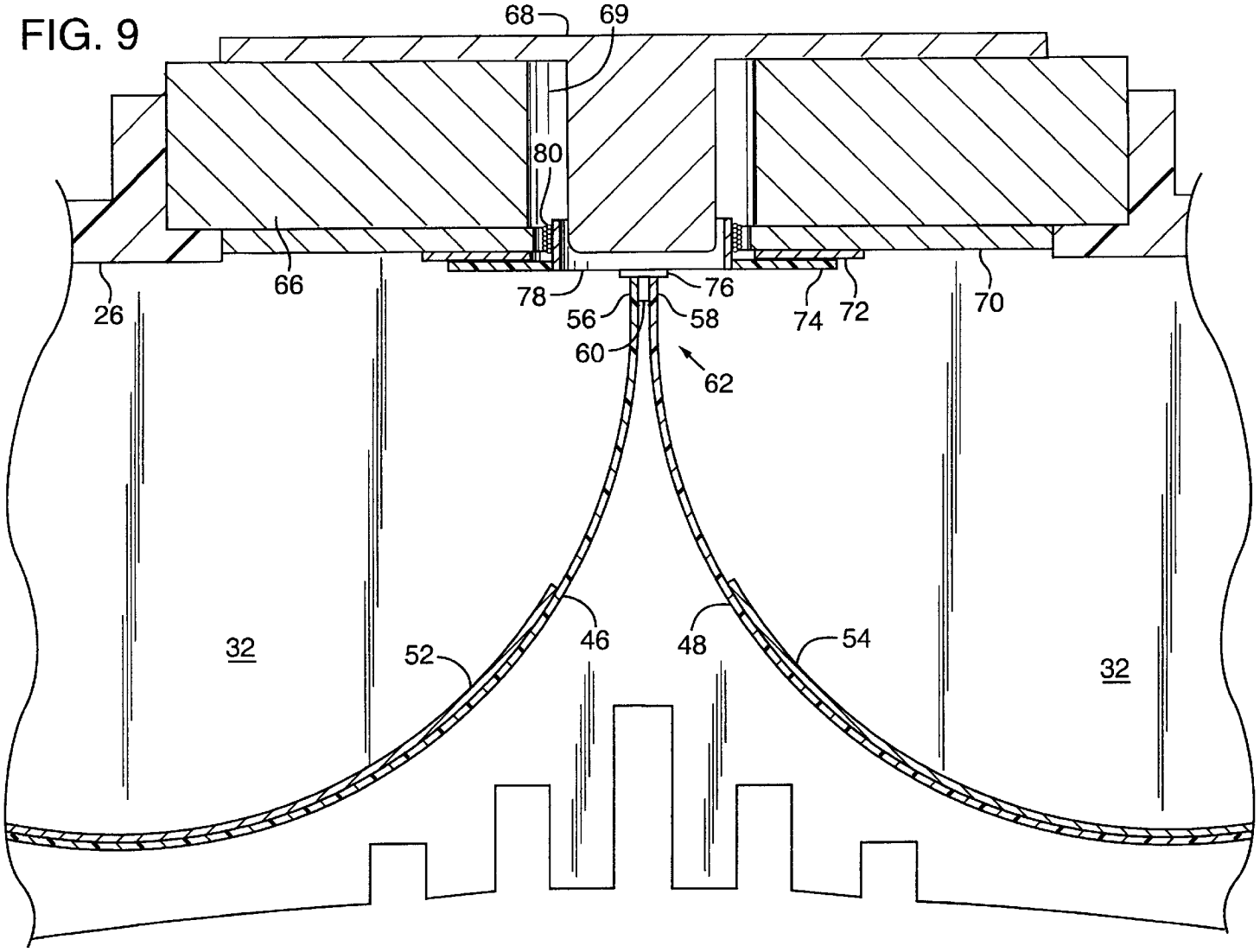
FIG. 9 is an enlarged, cross-sectional top view of the driver region of the audio transducer of FIG. 5

FIG. 9 is an enlarged cross-sectional top view of the driver region of the audio transducer of FIG. 5. In FIG. 9, one can observe the ring magnet 66, steel pole 68 and top plate 70 of the magnet structure in greater detail. The magnet structure is fixed to the frame 22 as noted above. The annular spacer 72 is fixed to the top plate 70, using a suitable adhesive, and it includes a central aperture having about the same diameter as the ring magnet core, and aligned as positioned therewith. A voice coil as formed of suitable coil wire 80, is wound around a bobbin 78, also shown in perspective view in FIG. 10. Thus, the voice coil refers to a fine, multiple-turn wire coil, closely wound around a thin bobbin of suitable material. Preferably, in a tweeter application, the bobbin 78 is formed of 0.5 to 1 mil. aluminum foil. The winding (on the bobbin) is suspended in the annular magnetic gap in such a fashion that it moves in step with an alternating current applied to the wires 80 in an up and down motion relative to the view in FIG. 9. With reference to FIGS. 5 and 6, the bobbin and coil oscillate along an axis normal to the back plate 26 of the frame, i.e., in a front/back direction, as we have described the transducer.

Figure 10:
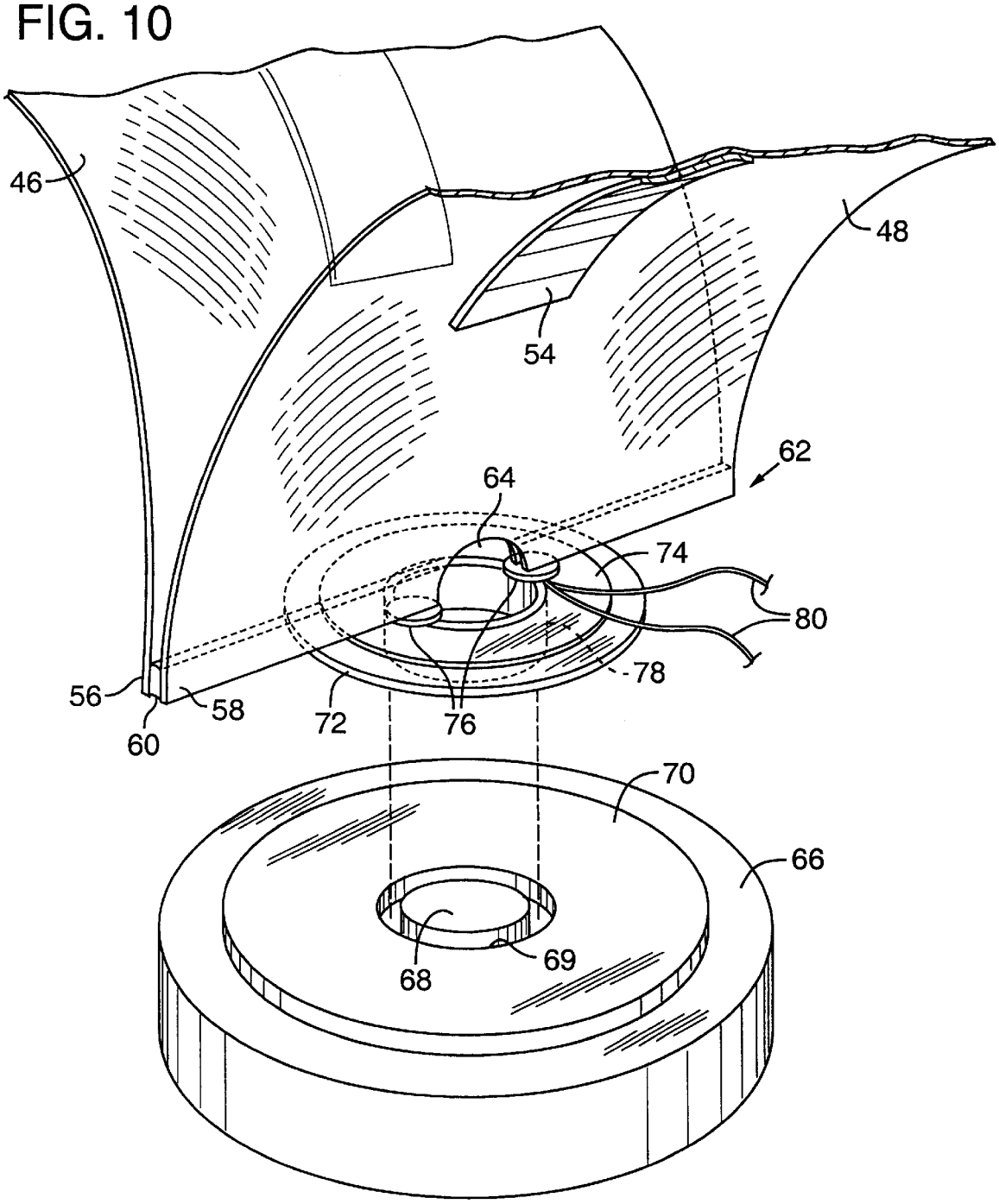
FIG. 10 is an enlarged, perspective view of the driver region of the audio transducer, showing the bobbin withdrawn from the magnet gap for clarity.

The bobbin/voice coil suspension system depends primarily upon the elastomeric mounting ring 74. The mounting ring 74 is disposed overlying and surrounding the annular magnetic gap and includes a central aperture formed in the ring, sized to surround yet clear the bobbin and coil. A radially outward circumferential region of the elastomeric region 74 is adhered to the spacer 72 and is thereby fixed to the magnet and frame. A radially-inward circumferential region of the mounting ring is free to oscillate. Before describing how the diaphragms are connected to the voice coil driver system, it is necessary to first describe certain aspects of the diaphragms in greater detail. First, as illustrated in FIGS. 9 and 10, the diaphragms are not formed of a singled, folded sheet of material. Rather, the diaphragms are formed of two separate sheets. Each diaphragm 46, 48, has a respective proximate end region 56, 58, respectively. As shown in cross section in FIG. 9, and in perspective view in FIG. 10, the proximate ends of the diaphragms are aligned in parallel, and interconnected by a decoupling pad disposed intermediate the proximate ends of the diaphragms and adhered to each of them. The decoupling pad 60 preferably is formed of a pliable material, and more specifically, can be conveniently formed of a closed-cell foam tape. The foam tape is adhered to the diaphragms by pressure-sensitive adhesive. The foam decoupling pad extends the full length of the proximate ends of the diaphragms, as shown in FIG. 10. These structures together form the diaphragm beam 62. The diaphragm beam 62 includes a central notch 64 as shown in FIG. 10. Notch 64 reduces the mass in this critical area of the vibrating system, and breaks the pathway for immediate end-to-end standing waves, and forms a "hinge point" in the otherwise ridged central beam area, allowing the vertical line to flex a higher frequencies—therefore improving vertical dispersion.

Figure 11:
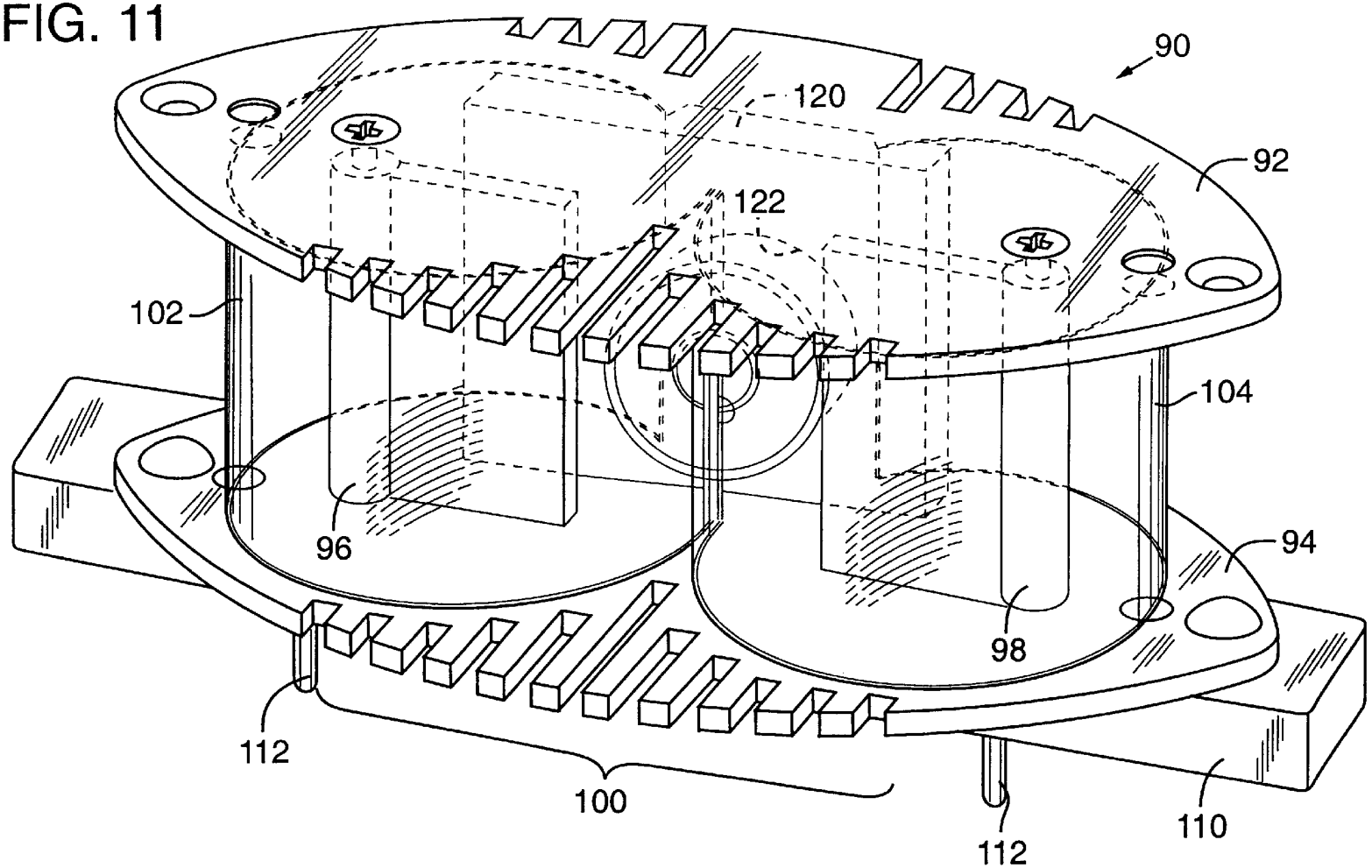
FIG. 11 is a perspective view of an alternative embodiment of the invention.

FIG. 11 is a perspective view of an alternative embodiment of an audio transducer 90. In this embodiment, a rigid frame comprises a top frame member 92 and similar bottom frame member 94 interconnected by a pair of mounting posts 96, 98, for holding the top and bottom frame members in a parallel, spaced apart relationship. The top and bottom frame members include a series of recesses, for example recesses 100, formed along both the front and back edges of the frame members to break up and disperse acoustic reflections between these frame members. Audio transducer 90 further includes a pair of generally cylindrical diaphragms 102 and 104 positioned in proximate, parallel relationship. The transducer 90 optionally further includes a rigid mounting member 110 which can further include electrical terminals 112 for connecting an audio signal source to the voice coil driver as further explained shortly.

Figure 12:
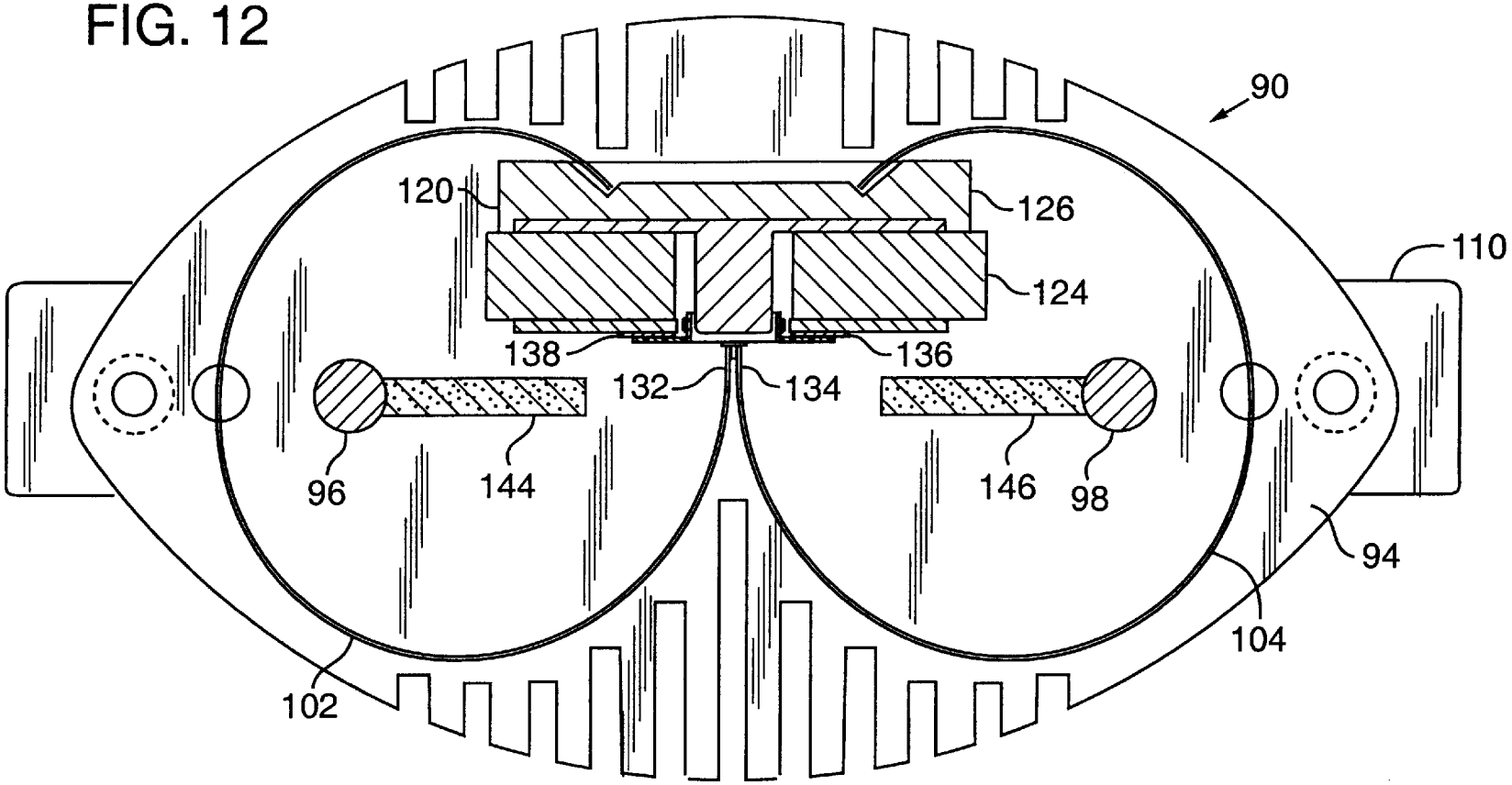
FIG. 12 is a top view partially in cross-section of the alternative embodiment transducer of FIG. 11.

FIG. 12 is a cross-sectional top view of the audio transducer 90. The frame further includes a rigid magnet mounting member 20 which is fixed in between the top and bottom frame members 92, 94 and includes a central aperture 122 (FIG. 11) sized to receive a permanent ring magnet mounted therein. In FIG. 11, the voice coil driver system includes a permanent ring magnet 124 with attached steel plate 126 extending through the central core of the ring magnet as described previously with reference to the first embodiment. Proximate ends 132, 134 of the diaphragms 102, 104, respectively, are connected to a decoupling pad as describe previously in the first embodiment with references to FIGS. 9 and 10. The alternative embodiment 90 further includes an elastomeric mounting ring 136, annular spacer 138, and a voice coil wound on a bobbin, again as described previously. Embodiment 90 also includes damping pads 144, 146 disposed in the interior regions of diaphragms 102, 104, respectively. The damping pads preferably are formed of a felt-type material and extend the full height between the top and bottom frame members 92, 94, as illustrated. These damping pads supress internal acoustic reflections.

Holes 150 in frame members receive elastomeric pads which extend to diaphragm edges—helping locate them in correct relationship with their fixtured ends and further supplying additional physical damping. This is not the only possible location for the "buttons"—a multiplicity of them could be distributed along the curved edges of the diaphragm and therefore supply enough physical damping to the diaphragm to obviate the need for the previously described damping tape (54).

What is claimed is:

1. An audio transducer comprising:

a rigid frame;

a permanent magnet mounted to the frame, the permanent magnet including first and second opposite polarity plates, the plates defining a substantially annular gap therebetween;

a bobbin sized and arranged to fit within the annular gap while permitting motion of the bobbin therein;

a voice-coil wound on the bobbin and connectable to receive an audio signal;

a pair of flexible, curved diaphragms each having a distal end thereof fixed to the frame, and each having a proximate end;

a decoupling pad disposed intermediate the proximate ends of the first and second curved diaphragms and adhered to the proximate ends of both of the first and second curved diaphragms for decoupling the pair of diaphragms from one another; and the bobbin connected to the pair of diaphragms adjacent the proximate ends thereof for transmitting energy to the diaphragms to generate sound in response to the audio signal.

2. An audio transducer according to claim 1 wherein the proximate linear ends of the diaphragms are oriented substantially normal to a central longitudinal axis of the bobbin.

3. An audio transducer according to claim 1 wherein the curved diaphragms are formed of a plastic film.

4. An audio transducer according to claim 1 wherein the curved diaphragms are formed of a polyester material.

5. An audio transducer according to claim 1 wherein the curved diaphragms have a thickness of approximately 0.002 inches.

6. An audio transducer according to claim 1 further comprising dampening means adhered to at least one of the curved diaphragms.

7. An audio transducer according to claim 1 wherein the decoupling pad is formed of a pliable material.

8. An audio transducer according to claim 1 wherein the decoupling pad is formed of a closed-cell foam tape.

9. An audio transducer according to claim 8 wherein the foam tape is adhered to the said proximate ends by a pressure-sensitive adhesive.

10. An audio transducer according to claim 8 wherein the tape has a thickness of approximately 1/32 inch.

11. An audio transducer according to claim 8 wherein the tape has a width of approximately 1/8 inch.

12. An audio transducer according to claim 1 and further comprising mounting means for supporting the bobbin suspended in the annular gap while allowing motion of the bobbin therein.

13. An audio transducer according to claim 12 wherein the mounting means including an annular mounting ring formed of a elastomeric material, the mounting ring disposed generally overlying and surrounding the annular gap and including a central aperture formed in the ring, the central aperture being sized to surround yet clear the bobbin and coil;

a radially outward circumferential region of the elastomeric ring being adhered to the frame to hold it permanently in place; and a radially inward circumferential region of the elastomeric ring being connected to the bobbin so as to support the bobbin suspended into the annular gap while allowing motion of the bobbin therein.

14. An audio transducer according to claim 13 wherein the radially inward circumferential region of the mounting ring is connected to the bobbin at at least two locations.

15. An audio transducer according to claim 13 wherein the mounting ring further includes at least two joining discs each located intermediate the radially inward circumferential region of the elastomeric ring and the bobbin and each adhered to both the ring and to the bobbin for connecting the ring to the bobbin.

16. An audio transducer according to claim 15 wherein the joining discs are made of metal.

17. An audio transducer according to claim 16 wherein the joining discs are made of aluminum.

18. An audio transducer according to claim 13 wherein the joining discs are generally circular and have a size of approximately 0.5 mil thickness and are approximately 0.125 inch in diameter.

19. An audio transducer according to claim 13 wherein the joining discs are symmetrically spaced apart on opposite sides of the mounting ring and adhered to it adjacent the central aperture.

20. An audio transducer according to claim 13 wherein the joining discs are adhered to a top edge of the bobbin.

21. An audio transducer comprising:

a frame;

a permanent magnet mounted to the frame, the permanent magnet including first and second opposite polarity plates, the plates defining a magnetic gap therebetween;

a bobbin sized and arranged to extend into an open end of the annular gap while permitting motion of the bobbin therein;

a voice-coil wound on the bobbin and connectable to receive an audio signal;

a pair of flexible, curved diaphragms arranged substantially in parallel, each diaphragm each having a distal end thereof fixed to the frame, and each diaphragm having a proximate end;

a decoupling pad disposed in between and adhered to the proximate ends of the diaphragms for decoupling the diaphragms from one another; so that the proximate ends of the diaphragms and the decoupling pad together form an elongate diaphragm beam aligned substantially in parallel to the longitudinal axes of the diaphragm; and the bobbin coupled to the diaphragm beam for transmitting energy to the diaphragms to generate sound in response to the audio signal.

22. An audio transducer according to claim 21 further comprising:

an elastomer mounting ring disposed overlying the ring magnet, the mounting ring having a central aperture aligned over the magnetic gap and sized to clear the bobbin and voice coil; and a pair of rigid joining disks, each of the joining disks being adhered to the mounting ring and adhered to the diaphragm beam and adhered to the bobbin thereby coupling the bobbin to the diaphragm beam.

* * * * *